US009164415B2

(12) United States Patent
Minegishi et al.

(10) Patent No.: US 9,164,415 B2
(45) Date of Patent: Oct. 20, 2015

(54) IMAGE FORMING APPARATUS AND METHOD OF FORMING AN IMAGE WHICH CAN PREVENT A DEVELOPMENT MEMORY FROM OCCURRING

(71) Applicant: Konica Minolta, Inc., Tokyo (JP)

(72) Inventors: Natsuko Minegishi, Tokyo (JP); Hideaki Tanaka, Tokyo (JP); Tetsuya Ishikawa, Kanagawa (JP); Ryoei Ikari, Saitama (JP); Shintaro Sone, Tokyo (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/267,172

(22) Filed: May 1, 2014

(65) Prior Publication Data

US 2014/0348525 A1 Nov. 27, 2014

(30) Foreign Application Priority Data

May 21, 2013 (JP) ..... 2013-107022

(51) Int. Cl.
*G03G 15/043* (2006.01)
*G03G 13/04* (2006.01)

(52) U.S. Cl.
CPC ..... *G03G 15/043* (2013.01); *G03G 13/04* (2013.01)

(58) Field of Classification Search
CPC ..... G03G 15/043; G03G 13/04
USPC ..... 399/49, 51
See application file for complete search history.

(56) References Cited

U.S. PATENT DOCUMENTS 8,521,045 B2 * 8/2013 Inada et al. ..... 399/46

FOREIGN PATENT DOCUMENTS

| | | | |
|---|---|---|---|
| JP | 8-54787 | A | 2/1996 |
| JP | 2006-145894 | A | 6/2006 |
| JP | 2008-224912 | A | 9/2008 |

* cited by examiner

*Primary Examiner* — William J Royer
(74) *Attorney, Agent, or Firm* — Cantor Colburn LLP

(57) ABSTRACT

An image forming apparatus includes: an image forming section including a light exposure section configured to expose an image bearing member to light to form an electrostatic latent image, the image forming section being configured to form a toner image on the image bearing member, and to form an image on a recording sheet by transferring the toner image onto the recording sheet; an estimation section configured to estimate a density lowering position on the basis of image data of an image formed by the image forming section, the density lowering position being a position where decrease in image density relative to a predetermined image density is caused in the image; and a control section configured to increase a light exposure amount at the density lowering position estimated by the estimation section on the image bearing member to an amount greater than a predetermined light exposure amount.

18 Claims, 12 Drawing Sheets

Prior Art

DIGITAL IMAGE DATA GENERATED BY IMAGE PROCESSING SECTION 130

CORRECTED DIGITAL IMAGE DATA

IMAGE FORMED ON RECORDING SHEET

| GRADATION VALUE $X_0$ TARGETED FOR CORRECTION | GRADATION OF PATCH IN CORRECTION OPERATION | DETECTED REFLECTION DENSITY | | | GRADATION OF DIGITAL IMAGE DATA | |
|---|---|---|---|---|---|---|
| | | PATCH ADJACENT TO WHITE PART | PATCH ADJACENT TO SOLID IMAGE PART | AMOUNT OF DECREASE IN DENSITY DUE TO DEVELOPMENT MEMORY | BEFORE CORRECTION | AFTER CORRECTION |
| $100 \leq X_0 < 120$ | 100 | D1 | d1 | D1−d1=A1 | $X_0$ | $X_0+X(A1)$ |
| $120 \leq X_0 < 140$ | 120 | D2 | d2 | D2−d2=A2 | $X_0$ | $X_0+X(A2)$ |
| $140 \leq X_0 < 160$ | 140 | D3 | d3 | D3−d3=A3 | $X_0$ | $X_0+X(A3)$ |
| $160 \leq X_0 < 180$ | 160 | D4 | d4 | D4−d4=A4 | $X_0$ | $X_0+X(A4)$ |
| $180 \leq X_0 < 200$ | 180 | D5 | d5 | D5−d5=A5 | $X_0$ | $X_0+X(A5)$ |
| $200 \leq X_0 < 220$ | 200 | D6 | d6 | D6−d6=A6 | $X_0$ | $X_0+X(A6)$ |
| $220 \leq X_0 < 240$ | 220 | D7 | d7 | D7−d7=A7 | $X_0$ | $X_0+X(A7)$ |

FIG. 11

| TONER CHARGE AMOUNT [μC/g] | EXAMPLE 1 | EXAMPLE 2 | COMPARATIVE EXAMPLE |
|---|---|---|---|
| 45 | A | A | B |
| 49 | A | A | C |
| 56 | A | A | C |
| 63 | A | A | C |
| 64 | A | A | C |

FIG. 12

IMAGE FORMING APPARATUS AND METHOD OF FORMING AN IMAGE WHICH CAN PREVENT A DEVELOPMENT MEMORY FROM OCCURRING

CROSS REFERENCE TO RELATED APPLICATIONS

This application is entitled and claims the benefit of Japanese Patent Application No. 2013-107022, filed on May 21, 2013, the disclosure of which including the specification, drawings and abstract is incorporated herein by reference in its entirety.

BACKGROUND OF THE INVENTION

1. Field of the Invention

The present invention relates to an image forming apparatus and a method of forming an image.

2. Description of Related Art

In an electrophotographic image forming apparatus, a developing device is employed in which the surface of a photoconductor drum is charged, and the charged region is exposed to light in accordance with an image data to form an electrostatic latent image, and the electrostatic latent image thus formed is developed to visualize (develop) the image.

In such a developing device, a two-component a developer containing carrier and toner is used, and the toner is frictionally charged and then absorbed by the electrostatic force of the electrostatic latent image formed on the surface of the photoconductor drum, whereby the electrostatic latent image is developed to form a toner image.

A developing roller of the developing device includes therein a plurality of magnetic poles, and a cylindrical developing sleeve which is rotatably supported on the outside of the developing roller. The developing roller conveys to a development region the carrier on which toner is attached, while holding the carrier on the developing sleeve, so as to perform development.

Incidentally, there has been a problem that, in the case where solid image parts 10 and non-image parts 20 are formed side by side on the leading-edge side of the image in the rotational axis direction of a photoconductor drum and thereafter halftone image 30 having a large area is formed as illustrated in FIG. 1, the image density of halftone image 30 becomes nonuniform under the influence of the image (solid image parts 10) of the previous rotation on the developing roller. This problem is known as uneven image density called "development memory."

Now, the mechanism of causing the development memory is described in detail. When an image partially having a high density part (solid image part 10) is printed, the height of the toner layer attached on the surface of the developing sleeve in the region corresponding to solid image part 10 (hereinafter referred to as "region A") is lower than that in the region corresponding to non-image part 20 (hereinafter referred to as "region B"). To be more specific, on the surface of the developing sleeve, the toner is attached in region B whereas the toner is not attached in region A. As a result, on the surface of the developing sleeve, the potential of the toner layer in region A is lower than in region B. In such case, when halftone image 30 having an uniform image density is printed after a potential difference is caused on the surface of the developing sleeve, the development property of toner on the photoconductor drum differs between region A and region B even when the same developing bias is applied thereto. That is, as illustrated in FIG. 1, under the influence of the image (solid image parts 10) of the previous rotation on the developing roller, portions 40 corresponding to solid image parts 10 undesirably have an image density lower than that of portions 50 corresponding to non-image parts 20 in halftone image 30 printed on recording sheet 60. In order to cancel this image density difference, the potential of the toner layer has to be uniformized by maintaining the state where the toner is uniformly attached on the surface of the developing sleeve or the state where no toner is attached on the surface of the developing sleeve, at the time of developing the electrostatic latent image on the surface of the photoconductor drum.

Japanese Patent Application Laid-Open No. 8-54787 discloses a technique of development in which a sleeve is rotated at least one revolution to remove the sleeve contamination before developing an electrostatic latent image only in the case where electric charge of a high charge amount is generated in developer due to a low humidity and thus the risk of sleeve contamination is raised. According to the technique disclosed in Japanese Patent Application Laid-Open No. 8-54787, when the sleeve rotates, rubbing between the developer attached to the sleeve and the developer in a development section removes the sleeve contamination.

Japanese Patent Application Laid-Open No. 2006-145894 discloses a technique of facilitating uniformization of the amount of the developer and the charge amount of the developer of a developer layer formed on a developer bearing member by limiting the ghost due to the development history on the developer bearing member. The developing device disclosed in Japanese Patent Application Laid-Open No. 2006-145894 includes: a rotatable developer bearing member which faces an image bearing member on which an electrostatic latent image is borne, bears on its surface the developer, and has an arithmetic average roughness Ra of 0.7 [μm] or less; a developer supply member which is disposed separately from the developer bearing member and to which a supply bias for facilitating supply of developer to the developer bearing member is applied; and in addition, a developer collecting member which faces the developer bearing member and applies a voltage to collect the developer remaining on the developer bearing member.

Japanese Patent Application Laid-Open No. 2008-224912 discloses a technique of preventing development memory regardless of the property of the developer to be used in the case of hybrid development. In the technique disclosed in Japanese Patent Application Laid-Open No. 2008-224912, a supply-magnet roller for forming a toner layer on a developing roller is oscillated to increase the scraping force for scraping the toner attached on the surface of the developing roller by a magnetic brush, thereby increasing the efficiency of collecting the toner remaining on the surface of the developing roller.

However, the problem with the technique disclosed in Japanese Patent Application Laid-Open No. 8-54787 is that, rubbing between the developer attached to the sleeve and the developer in the development section results in degradation of the developer, shortening the life of the developer.

In addition, the problem with the technique disclosed in Japanese Patent Application Laid-Open No. 2006-145894 is that, particularly in the case where a toner having a charge amount equal to or greater than 50 [μC/g ]is used, a part where the toner remaining on the surface of the developer bearing member can be completely removed and a part where the toner remaining on the surface of the developer bearing member cannot be completely removed may both be formed. Further, in the case where the toner remaining on the surface of the developer bearing member is not electrostatical and has a strong attaching force, removal of the remaining toner with use of electric field is difficult, and the part where toner can be completely removed and the part where toner cannot be completely removed may both be formed easily. In such case, undesirably, the development history on the developer bearing member cannot be sufficiently limited.

In addition, the problem with the technique disclosed in Japanese Patent Application Laid-Open No. 2008-224912 is that, in the case where the charge amount of the toner attached on the surface of developing roller is greater than 50 [μC/g], the attaching force of the toner attached on the surface of the developing roller is strong, and therefore the toner cannot be sufficiently removed from the surface of the developing roller by only the scraping with the magnetic brush.

Since the techniques according to Japanese Patent Application Laid-Open Nos. 8-54787, 2006-145894 and 2008-224912 have the above described problems, the techniques cannot be used as they are to solve the problem that the development memory occurs due to non-uniform potential in the toner layer on the surface of the developing sleeve.

SUMMARY OF THE INVENTION

An object of the present invention is to provide an image forming apparatus and a method of forming an image which can prevent a development memory from occurring.

To achieve the above-mentioned object, an image forming apparatus reflecting one aspect of the present invention includes: an image forming section including a light exposure section configured to expose an image bearing member to light to form an electrostatic latent image, the image forming section being configured to form a toner image on the image bearing member, and to form an image on a recording sheet by transferring the toner image onto the recording sheet; an estimation section configured to estimate a density lowering position on the basis of image data of an image formed by the image forming section, the density lowering position being a position where decrease in image density relative to a predetermined image density is caused in the image; and a control section configured to control the light exposure section to increase a light exposure amount at the density lowering position estimated by the estimation section on the image bearing member to an amount greater than a predetermined light exposure amount.

Desirably, in the image forming apparatus, the control section determines the light exposure amount to be increased at the density lowering position in accordance with the predetermined light exposure amount.

Desirably, in the image forming apparatus, the image forming section includes a developing roller configured to supply toner to the image bearing member, and the density lowering position is a position which is obtained by moving a position of a solid image part in the image to a downstream side of an image forming direction of the image by an amount corresponding to an integer multiple of a circumference of the developing roller.

Desirably, in the image forming apparatus, a gradation value greater than a predetermined value is set in advance for the solid image part.

Desirably, in the image forming apparatus, a difference in image density between a toner image formed with a gradation of the predetermined value and a toner image formed in advance with a gradation of a maximum value is equal to or smaller than a predetermined density difference.

Desirably, in the image forming apparatus, the control section sets a gradation value of the density lowering position to a value greater than a predetermined gradation value so as to increase the light exposure amount at the density lowering position on the image bearing member.

Desirably, in the image forming apparatus, the control section determines the light exposure amount to be increased at the density lowering position in accordance with a charge amount of toner supplied to the image bearing member.

Desirably, in the image forming apparatus, only when a charge amount of toner supplied to the image bearing member is greater than a predetermined charge amount, the control section increases the light exposure amount at the density lowering position on the image bearing member.

Desirably, in the image forming apparatus, the control section evaluates a degree of decrease in image density at the density lowering position in advance, and determines a light exposure amount to be increased at the density lowering position in accordance with the evaluated degree of decrease in image density.

In a method of forming an image in an image forming apparatus reflecting another aspect of the present invention, the image forming apparatus includes: an image forming section including a light exposure section configured to expose an image bearing member to light to form an electrostatic latent image, the image forming section being configured to form a toner image on the image bearing member, and to form an image on a recording sheet by transferring the toner image onto the recording sheet, and the method includes: a first step of estimating a density lowering position on the basis of image data of an image formed by the image forming section, the density lowering position being a position where decrease in image density relative to a predetermined image density is caused in the image; and a second step of controlling the light exposure section to increase a light exposure amount at the density lowering position estimated by an estimation section on the image bearing member to an amount greater than a predetermined light exposure amount.

Desirably, in the second step of the method, the light exposure amount to be increased at the density lowering position is determined in accordance with the predetermined light exposure amount.

Desirably, in the method, the image forming section includes a developing roller configured to supply toner to the image bearing member, and the density lowering position is a position which is obtained by moving a position of a solid image part in the image to a downstream side of an image forming direction of the image by an amount corresponding to an integer multiple of a circumference of the developing roller.

Desirably, in the method, a gradation value greater than a predetermined value is set in advance for the solid image part.

Desirably, in the method, a difference in image density between a toner image formed with a gradation of the predetermined value and a toner image formed in advance with a gradation of a maximum value is equal to or smaller than a predetermined density difference.

Desirably, in the second step of the method, a gradation value of the density lowering position is set to a value greater than a predetermined gradation value so as to increase the light exposure amount at the density lowering position on the image bearing member.

Desirably, in the second step of the method, the light exposure amount to be increased at the density lowering position is determined in accordance with a charge amount of toner supplied to the image bearing member.

Desirably, in the second step of the method, only when a charge amount of toner supplied to the image bearing member is greater than a predetermined charge amount, the light exposure amount at the density lowering position on the image bearing member is increased.

Desirably, in the second step of the method, a degree of decrease in image density at the density lowering position is evaluated in advance, and a light exposure amount to be increased at the density lowering position is determined in accordance with the evaluated degree of decrease in image density.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein:

FIG. 11 is a table illustrating expressions for correction of digital image data; and FIG. 12 is a table illustrating results of experiment in the embodiments and a comparative example.

DESCRIPTION OF THE PREFERRED EMBODIMENTS (First Embodiment)

Now, the first embodiment will be described in detail with reference to the drawings.

[Configuration of Image Forming Apparatus 100]

Figure 1:
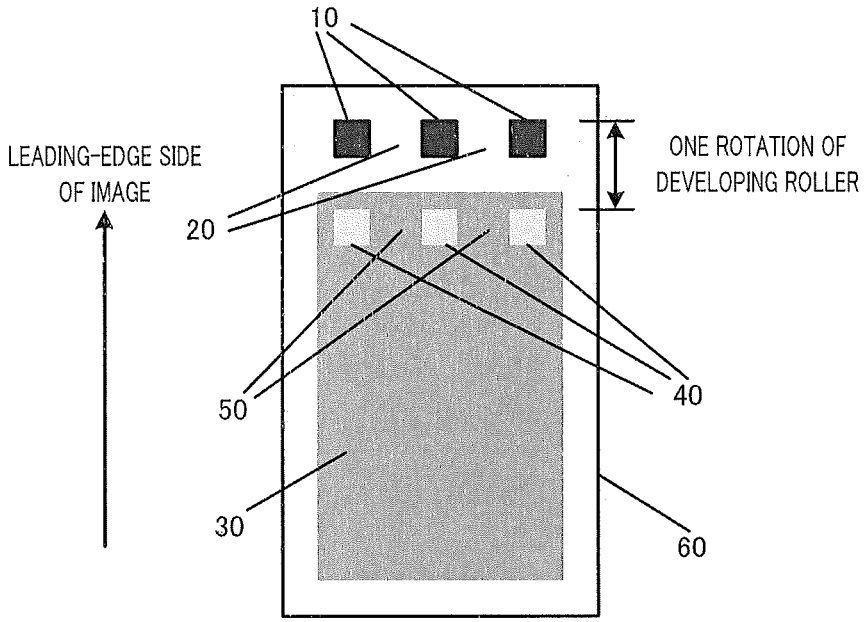
FIG. 1 is a schematic view for describing problems of the conventional art (occurrence of a development memory)
Figure 2:
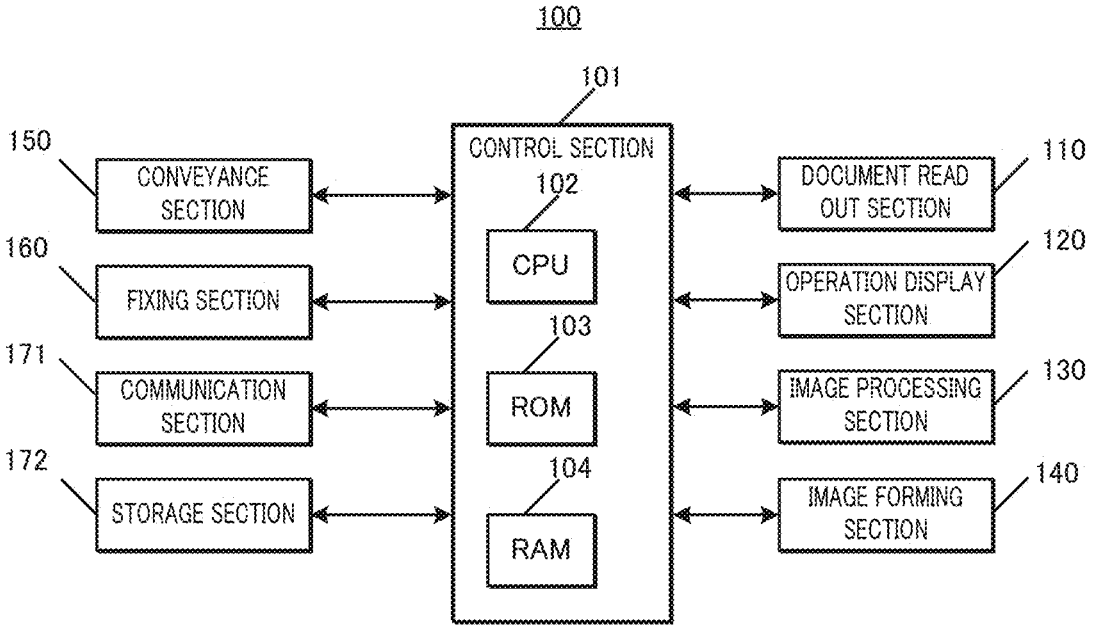
FIG. 2 is a control block diagram of an image forming apparatus according to a first embodiment.

Image forming apparatus 100 illustrated in FIG. 2 forms an image on a recording sheet by using the electrophotographic process. Image forming apparatus 100 includes control section 101, document read out section 110, operation display section 120, image processing section 130, image forming section 140, conveyance section 150, fixing section 160, communication section 171 and storage section 172. It is to be noted that control section 101 functions also as an estimation section.

Control section 101 includes Central Processing Unit (CPU) 102, Read Only Memory (ROM) 103, Random Access Memory (RAM) 104, and the like. CPU 102 reads out a program corresponding to the processing to be performed from ROM 103 and loads the program in RAM 104, and controls the operation of each block of image forming apparatus 100 in conjunction with the loaded program. At this time, various kinds of data stored in storage section 172 are referenced. Storage section 172 is composed of a nonvolatile-semiconductor memory (so-called flash memory) or a hard disk drive, for example.

Control section 101 exchanges various kinds of data, via communication section 171, with an external apparatus (for example, a personal computer) connected through a communication network such as local area network (LAN) and wide area network (WAN). For example, control section 101 receives image data sent from the external apparatus, and forms an image on a recording sheet based on the image data (received image data). Communication section 171 is composed of a communication control card such as a LAN card, for example.

Document read out section 110 optically scans a document conveyed onto a contact glass and brings light reflected from a document into an image on a light reception surface of charge coupled device (CCD) sensor, thereby reading out the image of the document. It is to be noted that, while the document is conveyed onto the contact glass by an automatic document feeder (ADF), the document may be manually placed on the contact glass.

Operation display section 120 includes a touch screen. Users can input various kinds of instructions and settings from the touch screen. Pieces of information relating to the instructions and settings are dealt by control section 101 as job information.

Image processing section 130 includes a circuit for performing analog-to-digital (A/D) conversion processing and a circuit for performing digital image processing. Image processing section 130 performs A/D conversion processing on an analog image signal acquired by a CCD sensor of document read out section 110 to generate digital image data, and outputs the generated digital image data to image forming section 140.

Image forming section 140 emits laser light based on the digital image data generated by image processing section 130, and irradiates a photoconductor drum with the emitted laser light to form an electrostatic latent image on the photoconductor drum (light exposure step).

Image forming section 140 includes configurations for carrying out steps including, in addition to the above-mentioned light exposure step, a charging step that is performed prior to the light exposure step, a development step that is performed after the light exposure step, a transferring step subsequent to the development step, and a cleaning step subsequent to the transferring step.

In the charging step, image forming section 140 uses corona discharge from a charging device to uniformly charge the surface of the photoconductor drum. In the development step, image forming section 140 causes toner contained in a developer in a developing device to adhere to an electrostatic latent image on the photoconductor drum, and thus forms a toner image on the photoconductor drum.

In the transferring step, image forming section 140 primary-transfers the toner image formed on the photoconductor drum to an intermediate transfer belt. In addition, image forming section 140 secondary-transfers the toner image formed on the intermediate transfer belt to a recording sheet conveyed by conveyance section 150 to form an image on the recording sheet. In the cleaning step, image forming section 140 removes toner remaining on the photoconductor drum after the transferring step.

Fixing section 160 includes a heating roller, a fixing roller, a fixing belt, and a pressure roller. The heating roller and fixing roller are disposed with a predetermined distance therebetween. A fixing belt is provided around the heating roller and fixing roller. The pressure roller is disposed in a state where it is in pressure contact with the fixing belt in a region where the fixing belt and fixing roller are in contact with each other. A fixing nip part is formed at a part where the fixing belt and pressure roller make contact with each other.

Fixing section 160 applies heat and pressure to the toner image formed on the recording sheet introduced in the fixing nip part (thermal fixation), thereby fixing the toner image to the recording sheet (fixing step). Thus, a fixed toner image is formed on the recording sheet. The recording sheet subjected to thermal fixation by fixing section 160 is ejected from image forming apparatus 100.

Next, the configuration of image forming section 140 will be described.

[Configuration of Image Forming Section 140]

Figure 3:
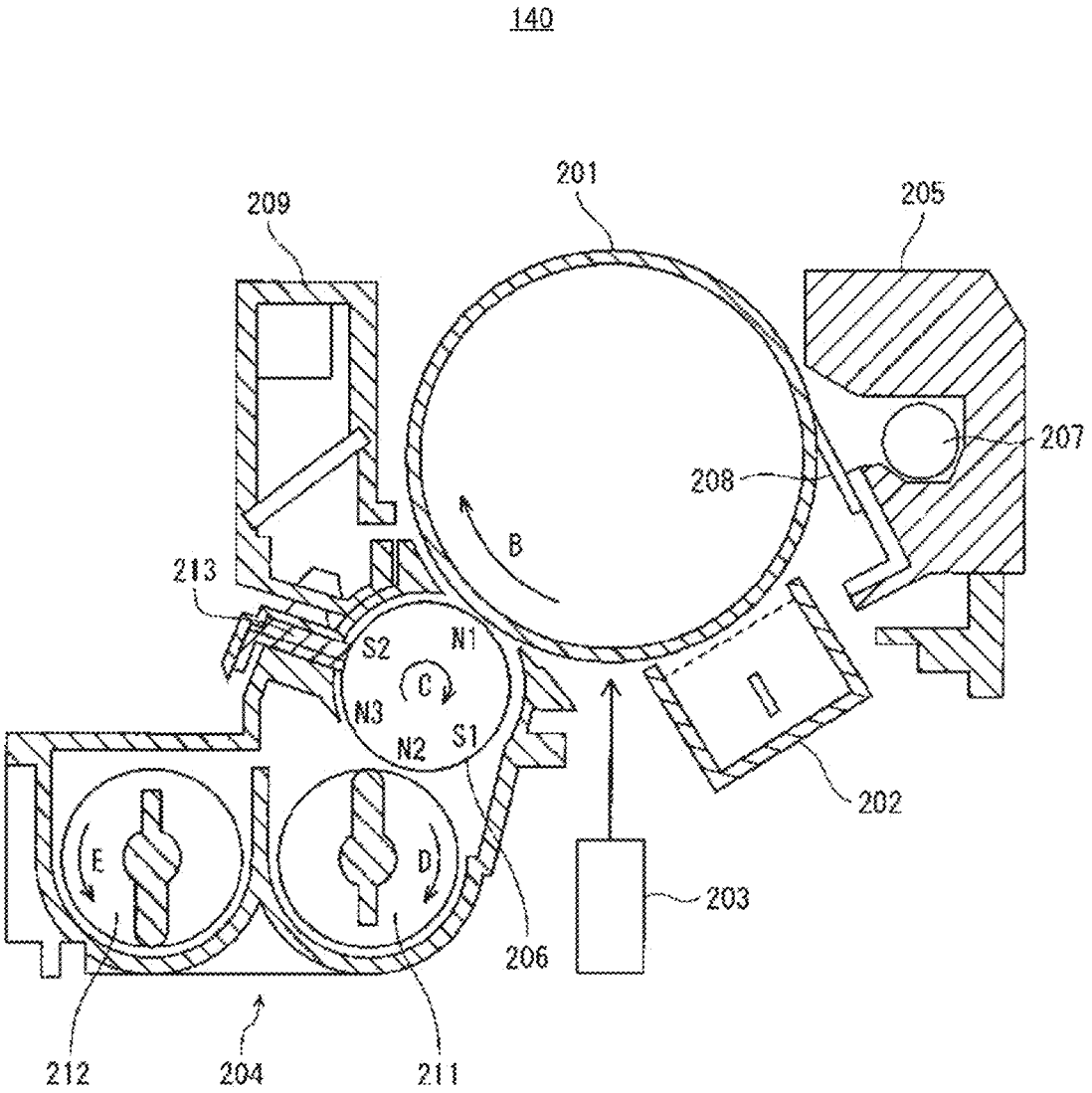
FIG. 3 illustrates a configuration of an image forming section according to the first embodiment.

As illustrated in FIG. 3, image forming section 140 includes photoconductor drum 201 (image bearing member), charging device 202, exposing device 203 (light exposure section), developing device 204 and cleaning device 205. It is to be noted that the description of the configuration for performing a secondary transferring step will be omitted. The process speed of image forming section 140 is, for example, 400 [mm/s].

Photoconductor drum 201 is driven into rotation by a driver (not illustrated) so as to be rotated in an arrow B direction. Charging device 202 uniformly charges the outer peripheral surface of photoconductor drum 201 by corona discharge.

Exposing device 203 includes a semiconductor laser device. Exposing device 203 irradiates the uniformly charged outer peripheral surface of photoconductor drum 201 with laser light, to thereby form an electrostatic latent image on the outer peripheral surface of photoconductor drum 201.

Developing device 204 receives supply of toner (mean particle diameter: 6.5 [μm]) and carrier (mean particle diameter: 33 [μm]) from a developer cartridge (not illustrated) via developer hopper 209. Developing device 204 agitates the supplied toner and carrier with agitation screw 212 to charge the toner. The developer (toner and carrier) thus agitated is supplied to developing roller 206 by supply screw 211. Agitation screw 212 rotates in an arrow E direction. Supply screw 211 rotates in an arrow D direction. Developing roller 206 rotates in an arrow C direction.

In developing roller 206, a developing sleeve rotates at a predetermined speed (for example, 720 [mm/s]) around a fixed magnet roller, and developer is supplied to the outer peripheral surface of the developing sleeve by supply screw 211. The outer diameter of developing roller 206 is, for example, 25 [mm]. When the developer supplied to the outer peripheral surface of the developing sleeve moves on the outer peripheral surface of the developing sleeve, the carrier forms a magnetic brush with the magnetic force of the magnetic pole provided to the magnet roller. The toner attached to the magnetic brush attaches to an electrostatic latent image on photoconductor drum 201. In other words, the electrostatic latent image of photoconductor drum 201 is developed by the toner. The average charge amount of the toner that develops the electrostatic latent image of photoconductor drum 201 is 45 to 64 [μC/g].

Regulating plate 213 regulates the thickness of the developer attached on the outer peripheral surface of the developing sleeve such that the developing sleeve conveys a predetermined amount of developer.

Cleaning device 205 exposes photoconductor drum 201 to light, with eraser lamp 207, to thereby neutralize the outer peripheral surface of photoconductor drum 201. At the time of cleaning, cleaning blade 208 makes contact with the outer peripheral surface of photoconductor drum 201 so as to mechanically scrape the toner remaining on the outer peripheral surface of photoconductor drum 201 after the primal transfer. In many cases, a conveying screw that conveys the toner scraped by cleaning blade 208 is provided at the position of eraser lamp 207. In such cases, eraser lamp 207 is disposed on the downstream side of cleaning device 205 in the rotational direction of photoconductor drum 201.

Incidentally, there has been a problem (development memory) that in the case where solid image parts and non-image parts are formed side by side on the leading-edge side of an image in the rotational axis direction of a photoconductor drum 201 and thereafter a halftone image having a large area is formed, the image density of the halftone image becomes nonuniform under the influence of the image (solid image part) of the previous rotation of the developing roller 206. To be more specific, in the halftone image printed on a recording sheet, the image density of the image of the next rotation of developing roller 206 from the solid image part is lower than the image density of the image of the next rotation of developing roller 206 from the non-image part.

In order to deal with the above-mentioned problem, in the present embodiment, control section 101 estimates, on the basis of image data of the image formed by image forming section 140, a position where the image density is decreased relative to a predetermined image density in the image, as a density lowering position. Control section 101 controls exposing device 203 to increase the light exposure amount at the estimated density lowering position on photoconductor drum 201 to an amount greater than a predetermined light exposure amount. Now, with reference to FIGS. 4A to 4C, an outline of a control operation by control section 101 will be described. Here, in the image formed on a recording sheet, solid image parts 300 and non-image parts are formed side by side on the leading-edge side of the image in the rotational axis direction of photoconductor drum 201 and thereafter halftone image 340 having a large area is formed.

Figure 4A:
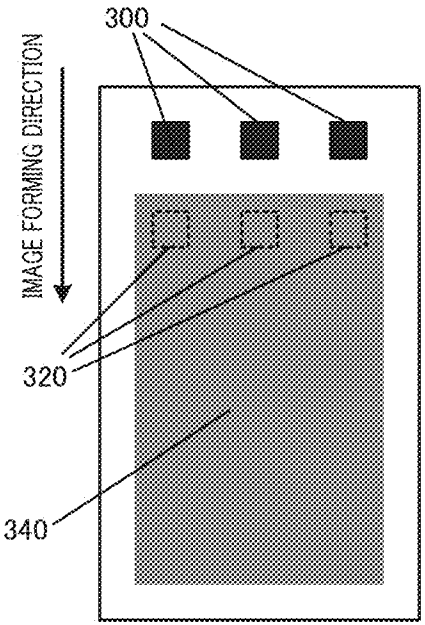
FIG. 4A is a schematic view for describing an outline of a correction operation on digital image data.

As illustrated in FIG. 4A, control section 101 detects solid image part 300 where a gradation value greater than a predetermined value (for example, 241) is set in advance, from the digital image data generated by image processing section 130, and estimates, as a density lowering position, position 320 which is obtained by moving the position of solid image part 300 to the downstream side of the image forming direction of the image by an amount corresponding to an integer multiple of the circumference of developing roller 206. It is to be noted that the gradation range is 256 gradations of 0 to 255 in the present embodiment.

Under the control of control section 101, image processing section 130 sets the gradation value of density lowering position 320 to a value greater than a predetermined gradation value, to thereby correct the digital image data such that the light exposure amount per unit area at density lowering position 320 on photoconductor drum 201 is increased to an amount greater than the predetermined light exposure amount. To be more specific, image processing section 130 sets the gradation value to a value greater than the predetermined gradation value. Image processing section 130 corrects the digital image data when the gradation value of density lowering position 320 is equal to or smaller than 240. This is because decrease in density due to the development memory is small when the gradation value of an image is equal to or greater than 241.

Figure 4B:
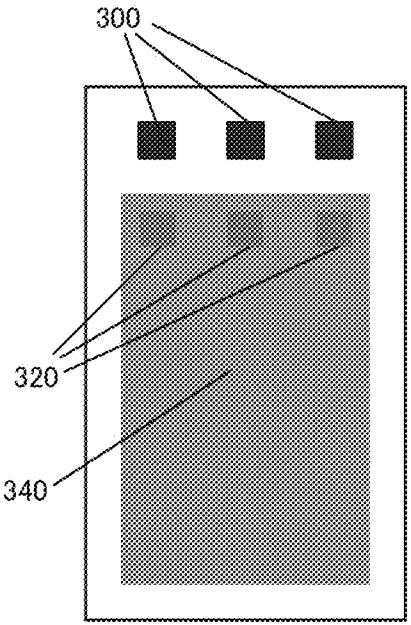
FIG. 4B is a schematic view for describing an outline of a correction operation on digital image data.

FIG. 4B illustrates an image based on corrected digital image data. As illustrated in FIG. 4B, the gradation value of density lowering position 320 is greater than the predetermined gradation value. Thus, in halftone image 340, the gradation value of density lowering position 320 is set to a value greater than the gradation value of the other areas than density lowering position 320.

Figure 4C:
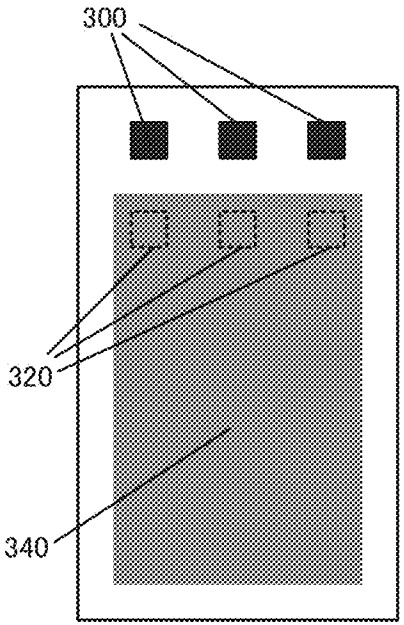
FIG. 4C is a schematic view for describing an outline of a correction operation on digital image data.

Under the control of control section 101, exposing device 203 exposes the photoconductor drum 201 to light to form an electrostatic latent image, on the basis of the corrected digital image data. Specifically, exposing device 203 increases the light exposure amount at density lowering position 320 on photoconductor drum 201 to an amount greater than the predetermined light exposure amount. FIG. 4C illustrates the resulting image formed on a recording sheet. As illustrated in FIG. 4C, in halftone image 340, the image density of density lowering position 320 is equal to that of the other areas than density lowering position 320, and the uneven image density (development memory) is not caused. This is because the increase in image density, which is achieved by increasing the light exposure amount at density lowering position 320 to an amount greater than the predetermined light exposure amount, is offset by the decrease in image density which is caused at density lowering position 320 due to the development memory.

Figure 5:
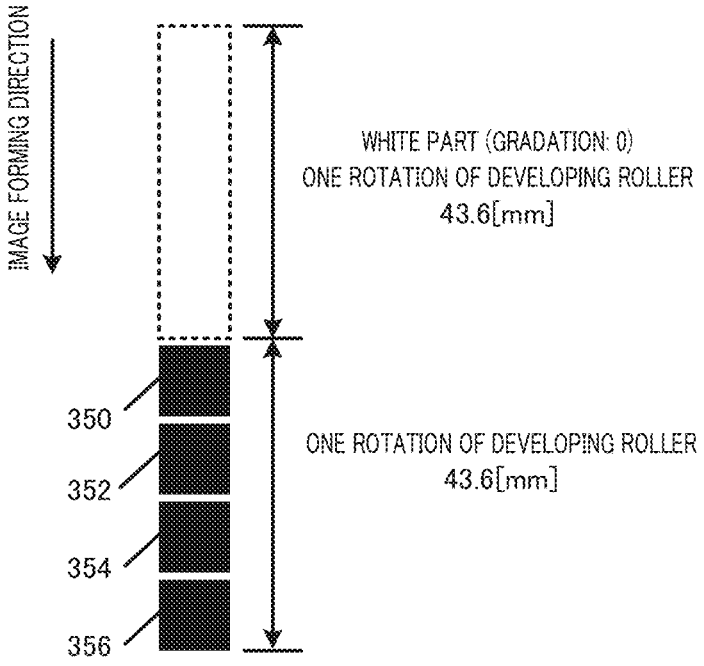
FIG. 5 is a schematic view for describing a method of setting a gradation range for determining a solid image part in an image based on digital image data.

Next, a method for setting the gradation range for determining a solid image part in the image based on the digital image data generated by image processing section 130 will be described. Specifically, as illustrated in FIG. 5, black patch images 350, 352, 354, and 356 which are previously set to have gradation values of 240, 245, 250 and 255, respectively, are formed on an intermediate transfer belt. It is to be noted that, before forming patch images 350, 352, 354, and 356, a white part having a gradation value of 0 is provided in a range of the length corresponding to one rotation of developing roller 206. The reason for this is to surely prevent the decrease in image density, since, when a solid image part is formed at the position of the white part, the image density of patch images 350, 352, 354, and 356 decreases under the influence of the solid image part.

Next, the reflection density of patch image 356 having a gradation value of 255, and the reflection densities of patch images 350, 352, and 354 having gradation values smaller than 255 are measured with an optical sensor. Finally, the differences (image density difference) between the reflection density of patch image 356 having the gradation value of 255, and the reflection densities of patch images 350, 352 and 354 having the gradation values smaller than 255 are calculated. From among the gradation values which provide image density differences equal to or smaller than a predetermined density difference (for example, 0.05), the smallest gradation value A3 is found. In the present embodiment, gradation value A3 is 240. That is, the gradation range for determining the solid image part is set to 241 to 255. The decrease in density due to the development memory is small in an image in the above-mentioned gradation range, and therefore the digital image data of such an image is not corrected. It is to be noted that, since the image density difference as the reference for setting the gradation range for determining the solid image part may change depending on the intended density set by the user, gradation value A3 may change in accordance with the change of the reference image density difference.

[Operation of Image Forming Apparatus 100]

Figure 6:
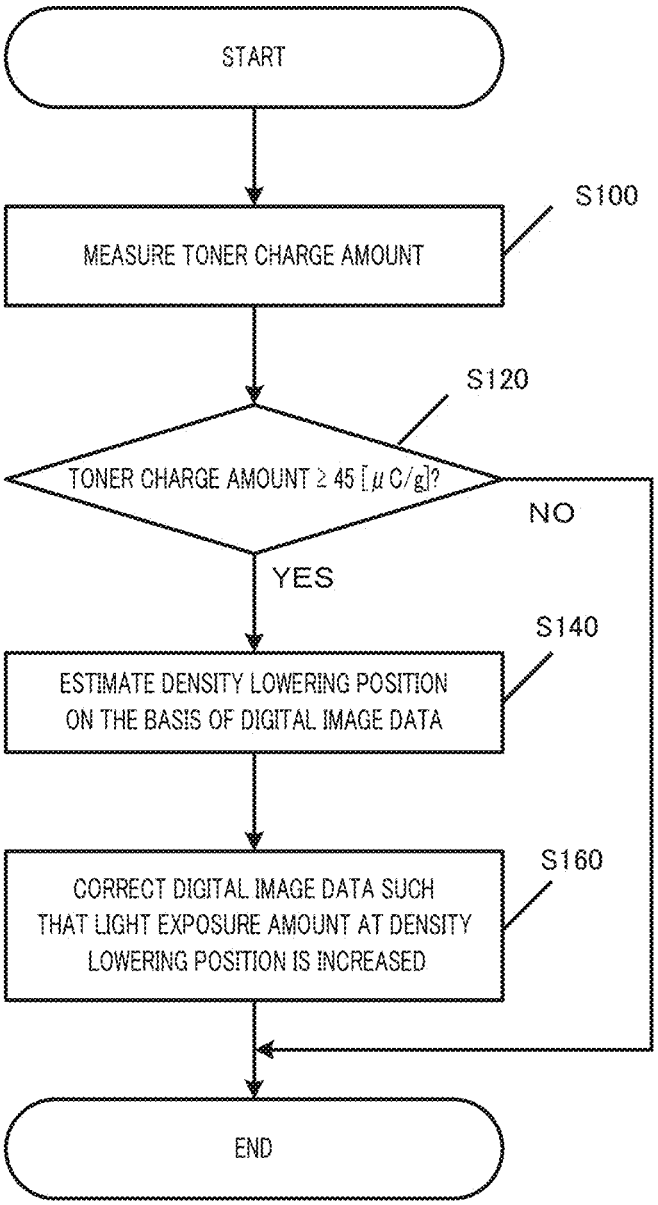
FIG. 6 is a flowchart for illustrating an exemplary operation of the image forming apparatus according to the first embodiment.

Next, a correction operation on digital image data by image forming apparatus 100 will be described with reference to the flowchart of FIG. 6. The processing of the steps illustrated in FIG. 6 is executed every time image processing section 130 generates digital image data, for example.

First, control section 101 measures a charge amount of toner (step S100). In the present embodiment, in advance, the optical reflection density of the patch image of the toner formed on the intermediate transfer belt is detected by a density sensor which is a reflection type photosensor. In storage section 172, a conversion table in which the correspondence relationship between the optical reflection density and the toner adhesion amount is described is stored. With reference to this conversion table, the toner adhesion amount [g/m2] is computed on the basis of a detected optical reflection density. In addition, a development current that flows between developing roller 206 and photoconductor drum 201 during development is measured. The development current is generated when toner moves from the surface of developing roller 206 to photoconductor drum 201 during development. The development current is proportional to the total electric charge amount per unit time of the moved toner, and therefore the total electric charge amount of a developed toner can be measured by measuring the development current. Control section 101 computes the charge amount of the toner (hereinafter referred to simply as "toner charge amount") per unit mass from the relationship between the value of the toner adhesion amount computed by above-described density sensor and the total electric charge amount.

It is to be noted that, while the toner charge amount is measured on the basis of the development current and the toner adhesion amount obtained from the optical density in the present embodiment, the measurement of the toner charge amount is not limited to this. Alternatively, the toner charge amount may be measured in such a manner that a potential on photoconductor drum 201 is measured by a non-contact surface electrometer before and after toner is developed to measure a potential of a toner layer, and thereafter the toner charge amount is calculated on the basis of the potential of toner layer and the above-described toner adhesion amount.

Next, control section 101 determines whether the measured toner charge amount is not less than 45 [μC/g] (step S120). When the toner charge amount is less than 45 [μC/g] (step S120, NO), image forming apparatus 100 terminates the processing of FIG. 6.

On the other hand, when the toner charge amount is equal to or greater than 45 [μC/g] (step S120, YES), control section 101 detects, on the basis of the digital image data generated by image processing section 130, a solid image part where a gradation value equal to or greater than a predetermined value (for example, 241) is set in advance, and estimates a position which is obtained by moving the position of the solid image part to the downstream side of the image forming direction of the image by an amount corresponding to an integer multiple of the circumference of developing roller 206, as a density lowering position (step S140).

Finally, under the control of control section 101, image processing section 130 sets the gradation value of the density lowering position to a value greater than the predetermined gradation value, to thereby correct the digital image data such that the light exposure amount per unit area at the density lowering position on photoconductor drum 201 is increased to an amount greater than the predetermined light exposure amount (step S160). Upon completion of the processing of step S160, image forming apparatus 100 terminates the processing of FIG. 6.

In the present embodiment, the gradation of the density lowering position is corrected by using correction expressions of Expressions (1) to (4). Since the amount of decrease in density due to the development memory is greater in the intermediate gradation, the correction amount of intermediate gradations is increased.

$$X=X_0 \text{ (when } 0\leq X_0<A_1=60) \quad (1)$$

$$X=(\alpha_1\cdot X_0+\beta_1)\cdot X_0 \text{ (when } 60\leq X_0<A_2=150) \quad (2)$$

$$X=(\alpha_2\cdot X_0+\beta_2)\cdot X_0 \text{ (when } 150\leq X_0<A_3=240) \quad (3)$$

$$X=X_0 \text{ (when } 240\leq X_0) \quad (4)$$

where $X_0$ represents a gradation value of a density lowering position prior to the correction, and X represents a gradation value of the density lowering position after correction. $A_1$ and $A_3$ represent threshold levels of the gradation at which the density difference due to the development memory becomes unnoticeable. That is, as is obvious from Expressions (1) and (2), since it has been confirmed experimentally that images having a gradation value smaller than 60 or images having a gradation value equal to or greater than 241 cause only small decrease in density due to the development memory, the gradation of the density lowering position is not corrected for such images. $A_2$ is an inflection point during the correction, in other words, a point at which the correction expression to be applied is changed depending on whether the gradation value of a density lowering position prior to the correction is not less than $A_2$. $A_2$ is also a gradation value at which the decrease in density due to the development memory is most frequently caused, which has been confirmed experimentally in advance.

In addition, the coefficients of the correction expressions of Expressions (2) and (3) are represented by Expressions (5) to (12).

$$\alpha_1=K_1\cdot C_2 \quad (5)$$

$$\alpha_2=K_2\cdot C_1 \quad (6)$$

$$K_1=0.00065 \quad (7)$$

$$K_2=-0.0006 \quad (8)$$

$$\beta_1=1-A_1\cdot\alpha_1 \quad (9)$$

$$\beta_2=1-A_3\cdot\alpha_2 \quad (10)$$

$$C_1=-0.0003\cdot(q/m)^2+0.0419\cdot(q/m)-0.1955 \quad (11)$$

$$C_2=0.0004\cdot(q/m)^2-0.0579\cdot(q/m)+2.8055 \quad (12)$$

wherein $C_1$ and $C_2$ are functions dependent on (q/m), and are secondary functions with respect to the toner charge amount (q/m) which is measured in step S100 of FIG. 6.

In order to complete the correction expressions of Expressions (1) to (4), constants $K_1$ and $K_2$ and functions $C_1$ and $C_2$ dependent on (q/m) must be calculated from the value obtained by the experiment performed in advance.

First, a procedure for obtaining constants $K_1$ and $K_2$ will be described. The smallest toner charge amount in the range of the toner charge amount for correction of digital image data is used as a reference, and is represented by $(q/m)_0$. As is obvious from the flowchart of FIG. 6, $(q/m)_0$ is 45 [μC/g] in the present embodiment. When the toner charge amount=$(q/m)_0$=45, $C_1=C_2=1$ is satisfied. In this case, as is obvious from Expressions (5) and (6), $\alpha 1=K_1$, $\alpha_2=K_2$ are satisfied.

Figure 7:
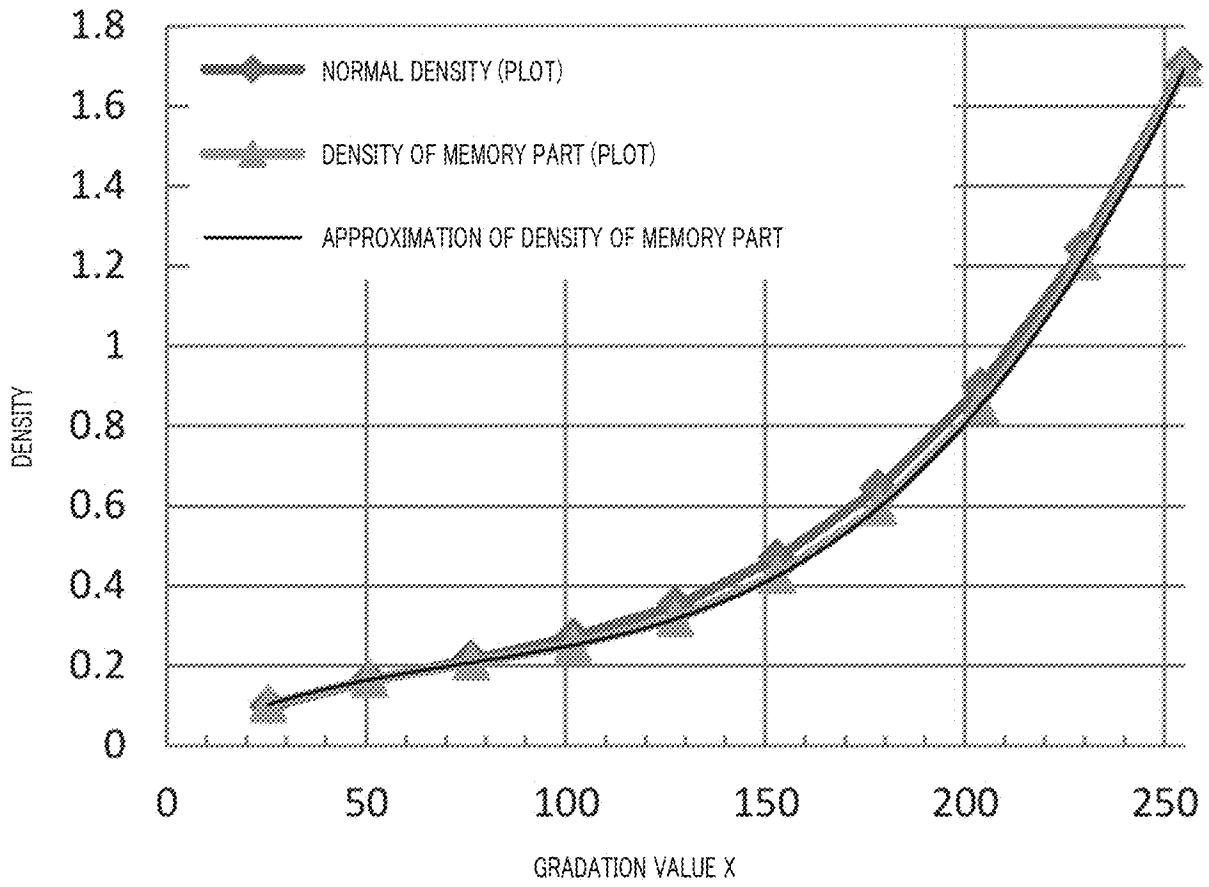
FIG. 7 is a graph illustrating measurement values of a normal density and a density of a memory part relative to the gradation value.

Next, when the toner charge amount=$(q/m)_0$, the density of a part where the development memory has not occurred (normal density), and the density of a part where the development memory has occurred (density of the memory part) are measured. As illustrated in FIG. 7, from the results of this measurement, the correlation between the gradation value X and the density of the memory part is plotted, with the abscissa showing the gradation value of the image and the ordinate the density, and the density of the memory part is approximated by cubic function Do(X) of Expression (13).

$$Do(X)=(2.08\times10^{-7})\cdot X^3-(4.7\times10^{-5})\cdot X^2+0.0051\cdot X \quad (13)$$

In the same graph, the correlation between gradation value X and the normal density is also plotted. Here, from the difference between the density of the memory part and the normal density plotted in the graph, $A_1$ and $A_3$ are determined as threshold levels of the gradation at which the density difference due to the development memory is substantially unnoticeable. Simultaneously, $A_2$, which is the inflection point of the development memory density difference, is determined. In the present embodiment, $A_1$, $A_2$, and $A_3$ are determined by visually confirming the graph.

Next, from the correction expressions of Expressions (2) and (3), $\beta_1$ and $\beta_2$ are obtained. It should be noted that the toner charge amount=$(q/m)_0$, $C_1=C_2=1$, $\alpha_1=K_1$, and $\alpha_2=K_2$.

When $X_0=A_1$ is satisfied, Expression (14) is derived from Expression (2).

$$X/X_0=1=\alpha_1\cdot X_0+\beta_1=K_1\cdot A_1+\beta_1 \quad (14)$$

Therefore, $\beta_1$ in Expression (15) can be obtained from Expression (14).

$$\beta_1=1-K_1\cdot A_1 \quad (15)$$

When $X_0=A_3$ is satisfied, Expression (16) is derived from Expression (3).

$$X/X_0=1=\alpha_2\cdot X_0+\beta_2=K_2\cdot A_3+\beta_2 \quad (16)$$

Therefore, β2 in Expression (17) can be obtained from Expression (16).

$$\beta_2=1-K_2\cdot A_3 \quad (17)$$

Next, after substituting an arbitrary value for $K_1$ in Expression (15), Expression (15) is substituted for Expression (2) to obtain corrected gradation value X with respect to uncorrected gradation value $X_0$. The value of $K_1$ is determined such that the plot of cubic function Do(X) matches that of normal density when corrected gradation value X obtained in the above-mentioned manner is substituted for Expression (13). It should be noted that the range in which K1 is used to compute corrected gradation value X is $A_1\leq X_0<A_2$.

Next, after substituting an arbitrary value for $K_2$ in Expression (17), Expression (17) is substituted for Expression (3) to obtain corrected gradation value X with respect to uncorrected gradation value $X_0$. The value of $K_2$ is determined such that the plot of cubic function Do(X) matches that of the normal density when corrected gradation value X obtained in the above-mentioned manner is substituted for Expression (13). It should be noted that the range in which K2 is used to compute corrected gradation value X is $A_2\leq X_0<A_3$.

Next, the procedure for obtaining functions $C_1$ and $C_2$ dependent on (q/m) will be described. Function $C_1$ dependent on (q/m) is a function applied to the correction of a high gradation region. Function $C_2$ dependent on (q/m) is a function applied to the correction of a low gradation region.

Figure 8:
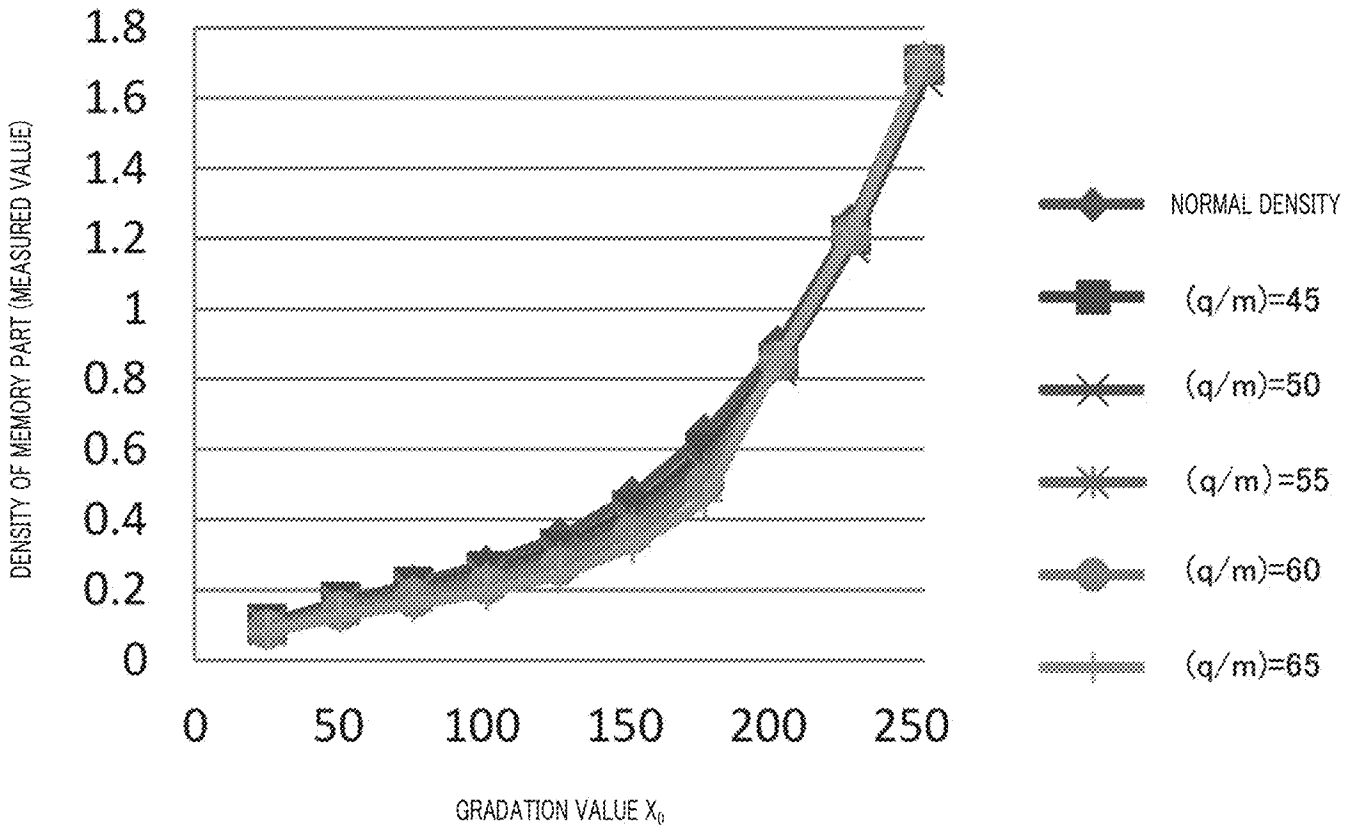
FIG. 8 is a graph illustrating measurement values of the density of the memory part relative to the gradation value for each toner charge amount.

FIG. 8 illustrates a graph of the measurement value of the density of the memory part on the ordinate versus uncorrected gradation value $X_0$ at the part where the development memory occurs on the abscissa, with respect to multiple standards of the toner charge amount (q/m). In the present embodiment, the multiple standards of the toner charge amount (q/m) include 50, 55, 60, and 65 [μC/g]. In this case, the toner charge amounts (q/m) and the density of the memory part are represented by $(q/m)_i$ and Di(X), respectively. From Expression (13), when the toner charge amount=$(q/m)_0$=45 [μC/g], the density of the memory part prior to the correction is represented by $Do(X_0)$, and the density of the memory part after the correction is represented by Do(X). Prior to the correction of the density of the memory part, in other words, when gradation value X=gradation value $X_0$, Expression (18) is satisfied, and C1 that satisfies the condition that $Di(X_0)$ that is measured in a high gradation region matches $Di(X_0)$ that is obtained by Expression (18) in a high gradation region is calculated.

$$Di(X_0)=Do(X_0)\cdot\{(q/m)_0/(q/m)_i\}\cdot C1 \quad (18)$$

The above-mentioned operation is performed on each toner charge amount $(q/m)_i$ to obtain function $C_1$ dependent on (q/m) that is a secondary function of the toner charge amount (q/m).

The procedure for obtaining function $C_2$ dependent on (q/m) is similar to the procedure for obtaining function $C_1$ dependent on (q/m). That is, before the density of the memory part is corrected, that is, when gradation value X=gradation value $X_0$, Expression (19) is satisfied, and C1 that satisfies the condition that $Di(X_0)$ that is measured in a high gradation region matches $Di(X_0)$ that is obtained by Expression (19) in a high gradation region is calculated.

$$Di(X_0)=Do(X_0)\cdot\{(q/m)_i/(q/m)_o\}\cdot C2 \quad (19)$$

The above-mentioned operation is performed on each toner charge amount $(q/m)_i$ to obtain function $C_2$ dependent on (q/m) that is the secondary function of the toner charge amount (q/m).

[Effect of First Embodiment]

As has been described in detail, in the first embodiment, image forming section 140 including exposing device 203 configured to expose photoconductor drum 201 to light to form an electrostatic latent image, the image forming section being configured to form a toner image on photoconductor drum 201, and to form an image on a recording sheet by transferring the toner image onto the recording sheet; an estimation section (control section 101) configured to estimate a density lowering position on the basis of image data of an image formed by the image forming section 140, the density lowering position being a position where decrease in image density relative to a predetermined image density is caused in the image; and control section 101 configured to control exposing device 203 to increase a light exposure amount at the density lowering position estimated by the estimation section on photoconductor drum 201 to an amount greater than a predetermined light exposure amount.

According to the first embodiment having the above-mentioned configuration, an increase in image density, which is achieved by increasing the light exposure amount at a density lowering position to an amount greater than a predetermined light exposure amount, is offset by a decrease in image density which is caused at the density lowering position due to the development memory. Thus, the development memory can be prevented from occurring at the density lowering position.

In addition, in the present embodiment, the gradation value of the density lowering position is set to a value greater than a predetermined gradation value, whereby the light exposure amount at the density lowering position on photoconductor drum 201 is increased. With this configuration, the light exposure amount on photoconductor drum 201 can be stably adjusted without adjusting the amount of laser light that is difficult to control.

In addition, in the present embodiment, the light exposure amount to be increased at the density lowering position is determined according to a predetermined light exposure amount (gradation value). The degree of decrease in density at the density lowering position differs depending on the predetermined gradation value. Thus, the light exposure amount to be increased at the density lowering position can be optimized.

In addition, in the present embodiment, the density lowering position in the image formed by image forming section 140 is a position which is obtained by moving the position of the solid image part to the downstream side of the image forming direction of the image by an amount corresponding to an integer multiple of the circumference of developing roller 206. The development memory most significantly stands out when it is formed under the influence of a solid image part. Accordingly, by only preventing the development memory due to the solid image part from being formed, the uneven image density of the image formed by image forming section 140 can be considerably reduced. In addition, the cycle in which the decrease in density due to the development memory is caused corresponds to the rotation cycle of developing roller 206. Accordingly, by setting the position at which the light exposure amount is corrected to a position which is obtained by moving the position of the solid image part to the downstream side of the image forming direction of the image from the position of the solid image part by an amount corresponding to an integer multiple of the circumference of developing roller 206, the position where decrease in density is caused due to the solid image part can be accurately estimated, and thus the development memory can be prevented from occurring at the position.

In addition, in the present embodiment, a gradation value equal to or greater than a predetermined value (for example, 241) is set in advance for the solid image part. In image data of an image formed by image forming section 140, a part having a gradation value greater than the predetermined value has an image density equal to that of a part having a gradation of a maximum value (for example, 255), which may cause the development memory. Therefore, by identifying a part having a gradation value greater than the predetermined value as the solid image part, the development memory can be surely prevented from being formed at the density lowering position. In addition, the image density difference between a toner image formed with a gradation of the predetermined value, and a toner image formed in advance with a gradation of a maximum value is equal to or smaller than the predetermined density difference (for example, 0.05). Thus, it is possible to prevent the problem that the light exposure amount is increased more than necessary at a part where the decrease in density due to the development memory is small.

In addition, in the present embodiment, the light exposure amount to be increased at the density lowering position is determined in accordance with the charge amount (q/m) of the toner supplied to photoconductor drum 201. The reason is that functions $C_1$ and $C_2$ dependent on (q/m), whose value varies according to the toner charge amount (q/m), are incorporated in the correction expression for correcting the gradation of the density lowering position. When the toner charge amount varies, the attaching property of toner on the outer peripheral surface of the developing sleeve, and the mobility of toner from developing roller 206 to photoconductor drum 201 vary, and consequently, the degree of the occurrence of the development memory changes. To be more specific, the greater the toner charge amount, the more easily the development memory occurs. Therefore, by determining the light exposure amount to be increased according to the toner charge amount, the light exposure amount to be increased at the density lowering position can be optimized.

In addition, in the present embodiment, only in the case where the charge amount of the toner supplied to photoconductor drum 201 is equal to or greater than the predetermined charge amount (45 [μC/g]), the light exposure amount at the density lowering position on photoconductor drum 201 is increased. With this configuration, it is possible to prevent the problem that the light exposure amount is increased more than necessary when the degree of the occurrence of the development memory is small, in other words, when the decrease in density due to the development memory is small.

(Second Embodiment)

In the following, the second embodiment will be described in detail with reference to the drawings. The basic configuration of image forming apparatus 100 is the same as in the first embodiment, and therefore the description thereof is omitted. The second embodiment differs from the first embodiment in the correction operation of image forming apparatus 100 which is performed on digital image data. In the present embodiment, when the gradation value of the density lowering position is equal to or greater than 100 and smaller than 240, image processing section 130 corrects digital image data. In other words, the following description will be made on the assumption that the fact that the decrease in density due to the development memory is small in images whose gradation value is smaller than 100 and equal to or greater than 240 has already been confirmed from results of experiment performed in advance.

[Operation of Image Forming Apparatus 100]

Figure 9:
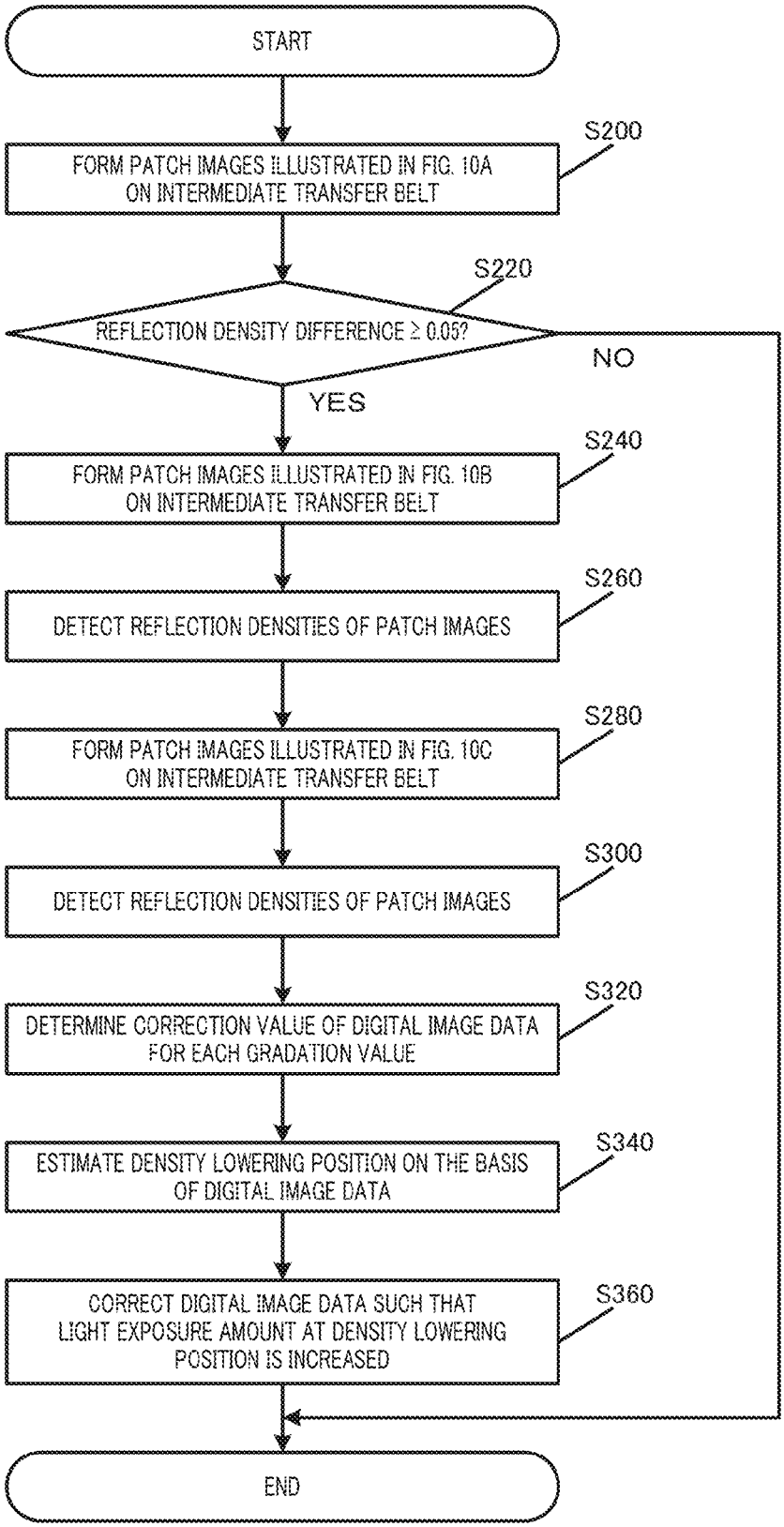
FIG. 9 is a flowchart for illustrating an exemplary operation of an image forming apparatus according to a second embodiment.

Next, with reference to the flowchart of FIG. 9, a correction operation of image forming apparatus 100 which is performed on digital image data will be described. The processing of the steps illustrated in FIG. 9 is executed every time image processing section 130 generates digital image data, for example. It is to be noted that gradation value X of the digital image data is represented by the function of reflection density D, X(D), in advance. Function X(D) can be obtained experimentally.

Figure 10A:
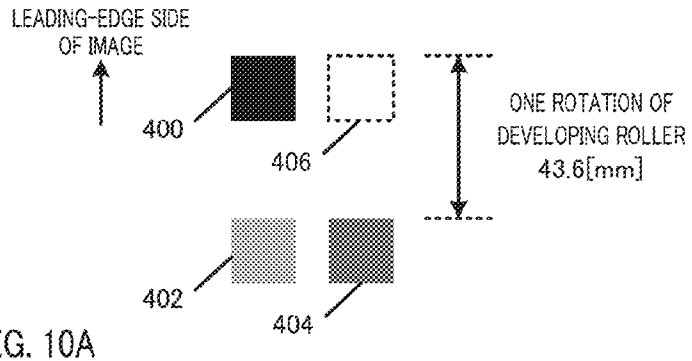
FIG. 10A illustrates patch images which are formed on an intermediate transfer belt during a correction operation on digital image data.
Figure 10B:
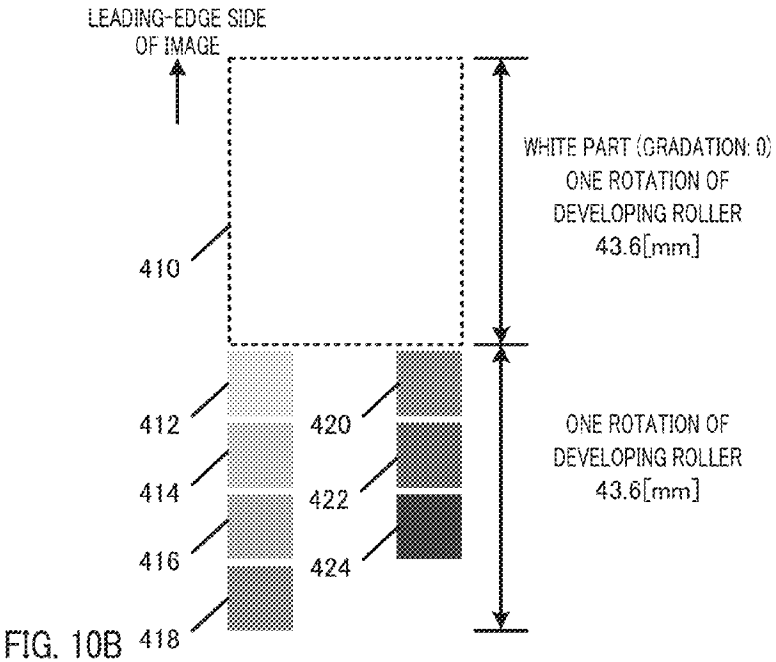
FIG. 10B illustrates patch images which are formed on an intermediate transfer belt during a correction operation on digital image data.
Figure 10C:
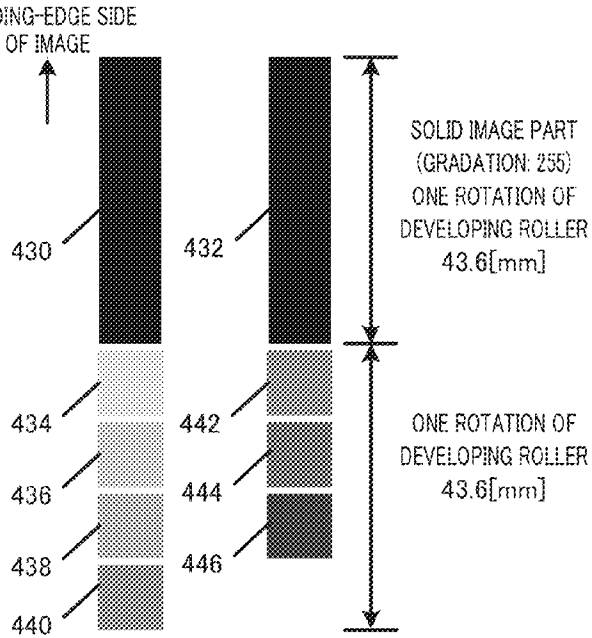
FIG. 10C illustrates patch images which are formed on an intermediate transfer belt during a correction operation on digital image data.

First, control section 101 controls image forming section 140 to form, on an intermediate transfer belt, black patch images 400, 402 and 404 illustrated in FIG. 10A (step S200). As illustrated in FIGS. 10A to 10C, patch image 400 composes a solid image part. Patch image parts 402 and 404 compose a halftone image part having an intermediate gradation. The image density of the halftone image part is non-uniform under the influence of patch image 400 (solid image part) of the previous rotation of the developing roller 206. That is, in the halftone image part, the image density of patch image 402 of the next rotation of developing roller 206 from patch image 400 is lower than the image density of patch image 404 of the next rotation of developing roller 206 from non-image part 406. Control section 101 acquires the reflection densities of patch images 402 and 404 which are detected by two reflection density sensors A and B (not illustrated) provided on the intermediate transfer belt.

Next, control section 101 determines whether the difference (reflection density difference) between the reflection densities of patch images 402 and 404, which is acquired from the two reflection density sensors, is not smaller than 0.05 (step S220). Here, the reflection density difference not smaller than 0.05 means that the user can recognize that the decrease in density due to the development memory is caused in patch image 402, when the user visually confirm patch images 402 and 404.

When it is determined at step S220 that the reflection density difference is smaller than 0.05 (step S220, NO), image forming apparatus 100 terminates the processing of FIG. 9. On the other hand, when the reflection density difference is equal to or greater than 0.05 (step S220, YES), control section 101 controls image forming section 140 to form, on the intermediate transfer belt, black patch images 412, 414, 416, 418, 420, 422 and 424 illustrated in FIG. 10B (step S240). The gradation values of patch images 412, 414, 416, 418, 420, 422 and 424 are 100, 120, 140, 160, 180, 200 and 220, respectively. It is to be noted that, before patch images 412, 414, 416, 418, 420, 422 and 424 are formed, white part 410 having a gradation value of 0 is provided in the range of the length corresponding to one rotation of developing roller 206. The reason for this is to surely prevent decrease in image density, since, when a solid image part is formed at the position of white part 410, the image density of patch images 412, 414, 416, 418, 420, 422 and 424 is decreased under the influence of the solid image part.

Next, reflection density sensors A and B detect the reflection densities of patch images 412, 414, 416, 418, 420, 422 and 424, and outputs the reflection densities to control section 101 (step S260). For example, reflection density sensor A detects the reflection densities of patch images 412, 414, 416 and 418. In addition, reflection density sensor B detects the reflection densities of patch images 420, 422 and 424. Control section 101 temporarily stores the reflection densities of patch images 412, 414, 416, 418, 420, 422 and 424 which are received from reflection density sensors A and B, in storage section 172.

Next, control section 101 controls image forming section 140 to form black patch images 434, 436, 438, 440, 442, 444 and 446 illustrated in FIG. 10C, on the intermediate transfer belt (step S280). The gradation values of patch images 434, 436, 438, 440, 442, 444 and 446 are 100, 120, 140, 160, 180, 200 and 220 , respectively. It is to be noted that, before patch images 434, 436, 438, 440, 442, 444 and 446 are formed, solid image parts 430 and 432 having a gradation value of 255 are provided in the range of the length corresponding to one rotation of developing roller 206. The reason for this is to confirm how the image densities of patch images 434, 436, 438, 440, 442, 444 and 446 are decreased under the influence of solid image parts 430 and 432.

Next, reflection density sensors A and B detect the reflection densities of patch images 434, 436, 438, 440, 442, 444 and 446, and output the reflection densities to control section 101 (step S300). For example, reflection density sensor A detects the reflection densities of patch images 434, 436, 438 and 440. In addition, reflection density sensor B detects the reflection densities of patch images 442, 444 and 446. Control section 101 temporarily stores the reflection densities of patch images 434, 436, 438, 440, 442, 444 and 446 which are received from reflection density sensors A and B in storage section 172.

Next, control section 101 reads out, from storage section 172, the detected reflection densities of patch images 412, 414, 416, 418, 420, 422 424, 434, 436, 438, 440, 442, 444 and 446, and determines how much the light exposure amount (gradation value) is to be increased (step S320) for each of the images having respective gradation values which fall within the gradation range within which the correction on the digital image data is supposed to be performed (100 to 240).

In the table illustrated in FIG. 11, the relationship between gradation value $X_0$ targeted for correction and the gradation value after the correction is defined. For example, when gradation value $X_0$ targeted for correction is equal to or greater than 100 and smaller than 120, the gradation value after the correction is $X_0$+X(A1). A1 is a value which is obtained by subtracting detected reflection density d1 of patch image 434 having a gradation value of 100, from detected reflection density D1 of patch image 412 having a gradation value of 100, that is, A1 represents the amount of decrease in density of patch image 434 due to the development memory. X(A1) is a value which is obtained by converting the amount of decrease in density of patch image 434 due to the development memory, into a gradation value in the digital image data. Accordingly, when gradation value $X_0$ targeted for correction is equal to or greater than 100 and smaller than 120, gradation value after the correction is $X_0$+X($A_1$), whereby the gradation value is increased by the gradation corresponding to the amount of decrease in density due to the development memory. It is to be noted that, since it can be said that the amount of decrease in density due to the development memory is substantially the same in the images having gradation value $X_0$ equal to or greater than 100 and smaller than 120, the amount of increase of the gradation value is uniformly X(A1) when uncorrected gradation value $X_0$ is equal to or greater than 100 and smaller than 120.

When gradation value $X_0$ targeted for correction is equal to or greater than 120 and smaller than 140, the gradation value after the correction is $X_0$+X(A2). A2 is a value which is obtained by subtracting detected reflection density d2 of patch image 436 having a gradation value of 120, from detected reflection density D2 of patch image 414 having a gradation value of 120, that is, A2 represents the amount of decrease in density of patch image 436 due to the development memory. X(A2) is a value which is obtained by converting the amount of decrease in density of patch image 436 due to the development memory, into a gradation value in the digital image data. Accordingly, when gradation value $X_0$ targeted for correction is equal to or greater than 120 and smaller than 140, gradation value after the correction is $X_0$+X (A2), whereby the gradation value is increased by the gradation corresponding to the amount of decrease in density due to the development memory. It is to be noted that, since it can be said that the amount of decrease in density due to the development memory is substantially the same in the images having gradation value $X_0$ equal to or greater than 120 and smaller than 140, the amount of increase of the gradation value is uniformly X(A2) when uncorrected gradation value $X_0$ is equal to or greater than 120 and smaller than 140.

When gradation value $X_0$ targeted for correction is equal to or greater than 140 and smaller than 160, the gradation value after the correction is $X_0$+X(A3). A3 is a value which is obtained by subtracting detected reflection density d3 of patch image 438 having a gradation value of 140, from detected reflection density D2 of patch image 416 having a gradation value of 140, that is, A3 represents the amount of decrease in density of patch image 438 due to the development memory. X(A3) is a value which is obtained by converting the amount of decrease in density of patch image 438 due to the development memory, into a gradation value in the digital image data. Accordingly, when gradation value $X_0$ targeted for correction is equal to or greater than 140 and smaller than 160, gradation value after the correction is $X_0$+X (A3), whereby the gradation value is increased by the gradation corresponding to the amount of decrease in density due to the development memory. It is to be noted that, since it can be said that the amount of decrease in density due to the development memory is substantially the same in the images having gradation value $X_0$ equal to or greater than 140 and smaller than 160, the amount of increase of the gradation value is uniformly X(A3) when uncorrected gradation value $X_0$ is equal to or greater than 140 and smaller than 160.

When gradation value $X_0$ targeted for correction is equal to or greater than 160 and smaller than 180, the gradation value after the correction is $X_0$+X(A4). A4 is a value which is obtained by subtracting detected reflection density d4 of patch image 440 having a gradation value of 160, from detected reflection density D4 of patch image 418 having a gradation value of 160, that is, A4 represents the amount of decrease in density of patch image 440 due to the development memory. X(A4) is a value which is obtained by converting the amount of decrease in density of patch image 440 due to the development memory, into a gradation value in the digital image data. Accordingly, when gradation value $X_0$ targeted for correction is equal to or greater than 160 and smaller than 180, gradation value after the correction is $X_0$+X (A4), whereby the gradation value is increased by the gradation corresponding to the amount of decrease in density due to the development memory. It is to be noted that, since it can be said that the amount of decrease in density due to the development memory is substantially the same in the images having gradation value $X_0$ equal to or greater than 160 and smaller than 180, the amount of increase of the gradation value is uniformly X(A4) when uncorrected gradation value X0 is equal to or greater than 160 and smaller than 180.

When gradation value $X_0$ targeted for correction is equal to or greater than 180 and smaller than 200, the gradation value after the correction is $X_0$+X(A5). A5is a value which is obtained by subtracting detected reflection density d5 of patch image 442 having a gradation value of 180, from detected reflection density D5 of patch image 420 having a gradation value of 180, that is, A5represents the amount of decrease in density of patch image 442 due to the development memory. X(A5) is a value which is obtained by converting the amount of decrease in density of patch image 442 due to the development memory, into a gradation value in the digital image data. Accordingly, when gradation value X0 targeted for correction is equal to or greater than 180 and smaller than 200, gradation value after the correction is $X_0$+X (A5), whereby the gradation value is increased by the gradation corresponding to the amount of decrease in density due to the development memory. It is to be noted that, since it can be said that the amount of decrease in density due to the development memory is substantially the same in the images having gradation value $X_0$ equal to or greater than 180 and smaller than 200, the amount of increase of the gradation value is uniformly X(A5) when uncorrected gradation value $X_0$ is equal to or greater than 180 and smaller than 200.

When gradation value $X_0$ targeted for correction is equal to or greater than 200 and smaller than 220, the gradation value after the correction is $X_0$+X(A6). A6 is a value which is obtained by subtracting detected reflection density d6 of patch image 444 having a gradation value of 200, from detected reflection density D6 of patch image 422 having a gradation value of 200, that is, A6 represents the amount of decrease in density of patch image 444 due to the development memory. X(A6) is a value which is obtained by converting the amount of decrease in density of patch image 444 due to the development memory, into a gradation value in the digital image data. Accordingly, when gradation value $X_0$ targeted for correction is equal to or greater than 200 and smaller than 220, gradation value after the correction is $X_0$+X (A6) , whereby the gradation value is increased by the gradation corresponding to the amount of decrease in density due to the development memory. It is to be noted that, since it can be said that the amount of decrease in density due to the development memory is substantially the same in the images having gradation value $X_0$ equal to or greater than 200 and smaller than 220, the amount of increase of the gradation value is uniformly X(A6) when uncorrected gradation value $X_0$ is equal to or greater than 200 and smaller than 220.

When gradation value $X_0$ targeted for correction is equal to or greater than 220 and smaller than 240, the gradation value after the correction is $X_0$+X(A7). A7 is a value which is obtained by subtracting detected reflection density d5 of patch image 446 having a gradation value of 220, from detected reflection density D7 of patch image 424 having a gradation value of 220, that is, A7 represents the amount of decrease in density of patch image 446 due to the development memory. X(A7) is a value which is obtained by converting the amount of decrease in density of patch image 446 due to the development memory, into a gradation value in the digital image data. Accordingly, when gradation value $X_0$ targeted for correction is equal to or greater than 220 and smaller than 240, gradation value after the correction is $X_0$+X (A7), whereby the gradation value is increased by the gradation corresponding to the amount of decrease in density due to the development memory. It is to be noted that, since it can be said that the amount of decrease in density due to the development memory is substantially the same in the images having gradation value $X_0$ equal to or greater than 220 and smaller than 240, the amount of increase of the gradation value is uniformly X(A7) when uncorrected gradation value $X_0$ is equal to or greater than 220 and smaller than 240.

Referring to the flowchart of FIG. 9 again, at step S340, control section 101 detects, on the basis of the digital image data generated by image processing section 130, a solid image part where a gradation value greater than a predetermined value (for example, 241) is set in advance, and estimates a position which is obtained by moving the position of the solid image part to the downstream side of the image forming direction by an amount corresponding to an integer multiple of the circumference of developing roller 206 as the density lowering position.

Finally, image processing section 130 refers to the table illustrated in FIG. 11, and sets the gradation value of the density lowering position to a value greater than a predetermined gradation value, to thereby correct the digital image data such that the light exposure amount per unit area at the density lowering position on photoconductor drum 201 is increased to an amount greater than a predetermined light exposure amount (step S360). Upon completion of the processing at step S360, image forming apparatus 100 terminates the processing of FIG. 9.

[Effect of Second Embodiment]

As has been described in detail, in the second embodiment, the degree of decrease in image density at the density lowering position is evaluated in advance, and the light exposure amount to be increased at the density lowering position is determined in accordance with the evaluated degree of decrease in image density. According to the second embodiment having the above-mentioned configuration, the light exposure amount to be increased at the density lowering position can be determined in accordance with the degree of decrease in the image density which has been actually caused due to the development memory, and thus the amount to be increased can be optimized.

[Modification]

While photoconductor drum 201 functions as an image bearing member in the first and second embodiments, the present invention is not limited thereto. For example, a photoconductor belt which is provided in place of photoconductor drum 201 may function as an image bearing member.

In addition, while patch images 412, 414, 416, 418,420, 422, 424, 434, 436, 438, 440, 442, 444, and 446 are formed on the intermediate transfer belt in the above-mentioned second embodiment, the present invention is not limited thereto. For example, it is also possible to adopt a configuration in which patch images 412, 414, 416, 418,420, 422, 424, 434, 436, 438, 440, 442, 444, and 446 are formed on photoconductor drum 201, and the reflection densities of patch images 412, 414, 416, 418,420, 422, 424, 434, 436, 438, 440, 442, 444, and 446 are detected by using reflection density sensors A and B.

It should be understood by those skilled in the art that various modifications, combinations, sub-combinations and alterations may occur depending on design requirements and other factors in so far as they are within the scope of the appended claims or the equivalents thereof.

EXAMPLES

Finally, results of an experiment performed by the present inventors for confirming the effects of the first and second embodiments will be described.

[Configuration of Image Forming Apparatus According to Examples 1 and 2]

As an image forming apparatus for the experiment, image forming apparatus 100 having the configurations shown in FIGS. 2 and 3 were used. Image forming apparatus 100 according to Example 1 performs the image forming operation described in the first embodiment. Image forming apparatus 100 according to Example 2 performs the image forming operation described in the second embodiment.

[Configuration of Image Forming Apparatus According to Comparative Example]

As an image forming apparatus for the experiment, image forming apparatus 100 which has the configuration shown in FIGS. 2 and 3 further includes a toner collecting roller which face developing roller 206 was used. The toner collecting roller forms a magnetic brush by magnetic force of an internally provided magnetic pole and rubs the surface of developing roller 206 to remove the toner attached to the surface of developing roller 206. Developing roller 206 has rotation speed V1 of 720 [mm/s]. Toner collecting roller has rotation speed V2 of 864 [mm/s]. That is, the rotation speed ratio (V2/V1) of developing roller 206 to the toner collecting roller is 1.2. The toner collecting roller rotates in a counter direction relative to the rotational direction of developing roller 206. In addition, unlike image forming apparatus 100 according to Examples 1 and 2, image forming apparatus 100 according to the comparative example does not perform the operation of increasing the light exposure amount at the estimated density lowering position on photoconductor drum 201 to an amount greater than a predetermined light exposure amount.

[Experiment Method]

In the experiment, under a condition where the toner charge amount is high and the development memory is easily caused, an image formation process was performed in which solid image parts and non-image parts are formed side by side on the leading-edge side of the image in the rotational axis direction of photoconductor drum 201 and thereafter a halftone image having a large area is formed. Then, the occurrence of the development memory on a recording sheet was visually checked.

FIG. 12 shows evaluations on the occurrence of the development memory for the cases where the toner charge amount is 45, 49, 56, 63, and 64 [μC/g] in Examples 1 and 2, and the comparative example, on the basis of the following evaluation criteria.

(Occurrence of Development Memory)

A: No development memory occurred in the image formed on the recording sheet (favorable).

B: The development memory occurred in the image formed on the recording sheet, only in a range which is allowable depending on the use, such as the use in the office.

C: The development memory significantly occurred in the image formed on the recording sheet (defective).

[Experiment Results]

The results suggest that, in the comparative example, as the toner charge amount increased, the occurrence of the development memory was worsened. In other words, in the halftone image formed on a recording sheet, the image density of the image of the next rotation of developing roller 206 from the solid image part is greater than the image density of the image of the next rotation of developing roller 206 from the non-image part. On the other hand, in Examples 1 and 2, the degree of the occurrence of the development memory was favorable even when the toner charge amount is increased to 64 [μC/g].

What is claimed is:

1. An image forming apparatus comprising:

an image forming section including a light exposure section configured to expose an image bearing member to light to form an electrostatic latent image, the image forming section being configured to form a toner image on the image bearing member, and to form an image on a recording sheet by transferring the toner image onto the recording sheet;

an estimation section configured to estimate a density lowering position on the basis of image data of an image formed by the image forming section, the density lowering position being a position where decrease in image density relative to a predetermined image density is caused in the image; and a control section configured to control the light exposure section to increase a light exposure amount at the density lowering position estimated by the estimation section on the image bearing member to an amount greater than a predetermined light exposure amount.

2. The image forming apparatus according to claim 1, wherein the control section determines the light exposure amount to be increased at the density lowering position in accordance with the predetermined light exposure amount.

3. The image forming apparatus according to claim 1, wherein the image forming section includes a developing roller configured to supply toner to the image bearing member, and the density lowering position is a position which is obtained by moving a position of a solid image part in the image to a downstream side of an image forming direction of the image by an amount corresponding to an integer multiple of a circumference of the developing roller.

4. The image forming apparatus according to claim 3, wherein a gradation value greater than a predetermined value is set in advance for the solid image part.

5. The image forming apparatus according to claim 4, wherein a difference in image density between a toner image formed with a gradation of the predetermined value and a toner image formed in advance with a gradation of a maximum value is equal to or smaller than a predetermined density difference.

6. The image forming apparatus according to claim 1, wherein the control section sets a gradation value of the density lowering position to a value greater than a predetermined gradation value so as to increase the light exposure amount at the density lowering position on the image bearing member.

7. The image forming apparatus according to claim 1, wherein the control section determines the light exposure amount to be increased at the density lowering position in accordance with a charge amount of toner supplied to the image bearing member.

8. The image forming apparatus according to claim 1, wherein, only when a charge amount of toner supplied to the image bearing member is greater than a predetermined charge amount, the control section increases the light exposure amount at the density lowering position on the image bearing member.

9. The image forming apparatus according to claim 1, wherein the control section evaluates a degree of decrease in image density at the density lowering position in advance, and determines a light exposure amount to be increased at the density lowering position in accordance with the evaluated degree of decrease in image density.

10. A method of forming an image in an image forming apparatus, the image forming apparatus including:

an image forming section including a light exposure section configured to expose an image bearing member to light to form an electrostatic latent image, the image forming section being configured to form a toner image on the image bearing member, and to form an image on a recording sheet by transferring the toner image onto the recording sheet, the method comprising:

a first step of estimating a density lowering position on the basis of image data of an image formed by the image forming section, the density lowering position being a position where decrease in image density relative to a predetermined image density is caused in the image; and a second step of controlling the light exposure section to increase a light exposure amount at the density lowering position estimated by an estimation section on the image bearing member to an amount greater than a predetermined light exposure amount.

11. The method according to claim 10, wherein, in the second step, the light exposure amount to be increased at the density lowering position is determined in accordance with the predetermined light exposure amount.

12. The method according to claim 10, wherein the image forming section includes a developing roller configured to supply toner to the image bearing member, and the density lowering position is a position which is obtained by moving a position of a solid image part in the image to a downstream side of an image forming direction of the image by an amount corresponding to an integer multiple of a circumference of the developing roller.

13. The method according to claim 12, wherein a gradation value greater than a predetermined value is set in advance for the solid image part.

14. The method according to claim 13, wherein a difference in image density between a toner image formed with a gradation of the predetermined value and a toner image formed in advance with a gradation of a maximum value is equal to or smaller than a predetermined density difference.

15. The method according to claim 10, wherein, in the second step, a gradation value of the density lowering position is set to a value greater than a predetermined gradation value so as to increase the light exposure amount at the density lowering position on the image bearing member.

16. The method according to claim 10, wherein, in the second step, the light exposure amount to be increased at the density lowering position is determined in accordance with a charge amount of toner supplied to the image bearing member.

17. The method according to claim 10, wherein, in the second step, only when a charge amount of toner supplied to the image bearing member is greater than a predetermined charge amount, the light exposure amount at the density lowering position on the image bearing member is increased.

18. The method according to claim 10, wherein, in the second step, a degree of decrease in image density at the density lowering position is evaluated in advance, and a light exposure amount to be increased at the density lowering position is determined in accordance with the evaluated degree of decrease in image density.

* * * * *